United States Patent [19]

Hashimoto

[11] Patent Number: 4,615,051

[45] Date of Patent: Oct. 7, 1986

[54] UNDERGARMENTS AND METHOD OF MAKING SAME

[75] Inventor: Kenji Hashimoto, Nishinomiya, Japan

[73] Assignee: Kenji Yabumoto, Hyogo, Japan; a part interest

[21] Appl. No.: 774,179

[22] PCT Filed: Nov. 11, 1980

[86] PCT No.: PCT/JP80/00278

§ 371 Date: Jul. 9, 1981

§ 102(e) Date: Jul. 9, 1981

[87] PCT Pub. No.: WO81/01357

PCT Pub. Date: May 28, 1981

Related U.S. Application Data

[63] Continuation of Ser. No. 608,528, May 8, 1984, abandoned, which is a continuation of Ser. No. 285,085, Jul. 9, 1981, abandoned.

[30] Foreign Application Priority Data

Nov. 15, 1979 [JP] Japan ..... 54-159104[U]

[51] Int. Cl.[4] ..... A41B 9/04

[52] U.S. Cl. ..... 2/406; 2/243 R

[58] Field of Search ..... 2/406, 407, 403, 404, 2/400, 402, 409, 243 R

[56] References Cited

U.S. PATENT DOCUMENTS

| | | | |
|---|---|---|---|
| 2,443,474 | 6/1948 | Morgan | 2/67 |
| 2,513,039 | 6/1950 | Miller | 2/406 |
| 3,016,900 | 1/1962 | Title | 2/406 |
| 3,344,438 | 10/1967 | Title | 2/406 |
| 3,487,473 | 1/1970 | Janhsen | 2/409 X |
| 4,003,094 | 1/1977 | Newmar | 2/409 |
| 4,229,835 | 10/1980 | Shaw | 2/406 |

FOREIGN PATENT DOCUMENTS

| | | | |
|---|---|---|---|
| 3039416 | 5/1981 | Fed. Rep. of Germany | 2/406 |
| 672894 | 4/1929 | France | 2/406 |
| 2312209 | 5/1976 | France | 2/406 |
| 779595 | 7/1957 | United Kingdom | 2/406 |

*Primary Examiner*—H. Hampton Hunter

*Attorney, Agent, or Firm*—Armstrong, Nikaido, Marmelstein & Kubovcik

[57] ABSTRACT

Panties, briefs or like undergarment comprises a front piece 2 for covering the lower abdomen, a rear piece 3 chiefly for covering the buttocks, and a connector piece 4 connecting the front piece 2 to the rear piece 3 for covering the crotch. The front piece 2 has a projection extending outward from each of its upper opposite side portions. The rear piece 3 has a projection extending outward from each of its upper opposite side portions obliquely upward and an upper edge 35 curved inward most greatly on the center line of the rear piece 3. The front piece 2 and the rear piece 3 are stitched together at the opposed ends 24 and 34 of their projections 21 and 31.

10 Claims, 13 Drawing Figures

UNDERGARMENTS AND METHOD OF MAKING SAME

This application is a continuation of application Ser. No. 608,528 filed May 8, 1984, which in turn is a continuation of Ser. No. 285,085 filed on July 9, 1981, both abandoned.

TECHNICAL FIELD

This invention relates to panties, briefs and like undergarments and to a method of making such undergarments.

BACKGROUND ART

With conventional undergarments, such as panties and briefs, the piece of fabric for covering the lower abdomen and the piece of fabric for covering the buttocks are formed in conformity with the shapes obtained by projecting the lower abdomen and the buttocks from the front or rear, with no consideration given to the bulges of the lower abdomen, lateral regions and buttocks of the human body. Accordingly when such an undergarment is worn, the large prominences of the buttocks tension the buttock covering piece, pulling the lower abdomen covering piece toward the buttocks through the crotch and consequently drawing the abdomen covering piece downward in its entirety, with the midportion of its width pulled most strongly. As a result, the upper hem of the abdomen covering piece is curved downward most markedly at the midportion. With the front portion of the undergarment pulled down, the rear portion of the undergarment, i.e. the buttock covering piece, is raised relative thereto. Thus the upper hem of the undergarment inclines downward from the rear toward the front. The undergarment then appears unattractive in design and feels uncomfortable to wear.

Undergarments heretofore known have another problem that when they are worn, the portion of the undergarment covering the buttocks extends merely in a planar fashion over the gluteal cleft between the buttocks and hangs loosely at its lower part to form wrinkles, thus failing to give a graceful appearance. Conventional undergarments are further uncomfortable to wear since the garment is unable to fit over the buttocks and the gluteal cleft in intimate contact therewith for enclosing and supporting these body portions.

The present invention has overcome the above drawbacks and provides panties, briefs and like undergarments which appear graceful in design and are comfortable to wear, and a method of making such undergarments.

DISCLOSURE OF INVENTION

Throughout the specification and the appended claims, the terms "upper" or "upward" and "lower" or "downward" as used for undergarments and component pieces thereof are based on the position of the undergarment worn on the human body.

The undergarments of this invention comprise a front piece for covering the lower abdomen, a rear piece chiefly for covering the buttocks, and a connector piece interconnecting the front piece and the rear piece for covering the crotch, the front piece having a projection extending outwardly from each of its upper opposite side portions, the rear piece having a projection extending outwardly and obliquely upwardly from each of its upper opposite side portions, the rear piece having an upper edge curved inwardly with the degree of curvature being greatest on the center line of the rear piece, the projections of the front piece being stitched to the projections of the rear piece at their opposed ends.

Since the projections of the rear piece extend outwardly and obliquely upwardly from the upper opposite side portions thereof with the upper edge of the rear piece curved and recessed to the greatest extent on the center line of the rear piece, the rear piece can be bulged in conformity with the prominences of the rearwardly bulging buttocks and the sidewise projecting lateral regions of the human body. The undergarment is therefore comfortable to wear. When the garment is worn, the upper hem thereof is positioned along a straight line horizontally, so that the undergarment appears graceful in design.

The present invention is useful for providing undergarments of any of the following types: the deep-type undergarment which is adapted to fully cover the forwardly bulging portion of the lower abdomen with its front piece; the medium depth-type undergarment which has an upper hem positionable on the top of the bulge of the lower abdomen; and the shallow-type undergarment which has an upper hem positionable some distance below the top of the bulge. The characteristic shapes of the front and rear pieces included in these types of undergarments will become apparent from the following description of embodiments. Further according to the present invention, the seams of the projections of the front and rear pieces are so positioned as to give an attractive appearance to the undergarment.

The present invention also provides a method of making undergarments by stitching together at suitable portions a front piece for covering the lower abdomen, a rear piece chiefly for covering the buttocks and a connector piece for covering the crotch, the method comprising forming on the front piece a projection extending outwardly from each of its upper opposite side portions, forming on the rear piece a projection extending outwardly and obliquely upwardly from each of its upper opposite side portions, forming on the rear piece an upper edge which curves inwardly to the greatest extent on the center line of the rear piece, stitching the projections of the front piece to the projections of the rear piece at their opposed ends, and stitching the rear piece and the connector piece together at adjoining portions thereof while stretching the rear piece toward the connector piece most greatly along the center line of the rear piece and to a progressively lesser extent from the center line toward the opposite sides thereof to form an elongated depression on the center line of the rear piece and a bulged portion on each side of the depression.

Accordingly when the undergarment made is worn, the upper hem of the garment is positioned along a straight line horizontally. Since the undergarment is formed with bulges which conform to the bulges of the buttocks and of the lateral regions of the human body and also with a depression which is positionable along the gluteal cleft, the undergarment is intimately fittable to curves of the human body, appears graceful and feels smooth and comfortable. In addition the undergarment can be made with extreme ease without necessitating any special procedure or material for cutting the fabric material or for the sewing step.

The undergarments of the present invention are made preferably from stretchable knitted fabrics. According to the method of this invention, the front piece, the rear piece and the connector piece may be cut out from a fabric individually separately. Alternatively the rear piece and the connector piece may be cut out as an integral piece.

The present invention is useful not only for panties and briefs but also for corsets, girdles, etc. for covering the lower trunk of the human body. The invention is similarly applicable in the case where the lower trunk portions of leotards, bathing suits, sportswear, foundation garments such as all-in-ones, etc. which are adapted to cover both the upper and lower trunks of the body are prepared separately from the upper trunk portions and then stitched together with the latter.

BEST MODE OF CARRYING OUT THE INVENTION

With reference to the drawings, the present invention will be explained in detail below.

Figure 2:
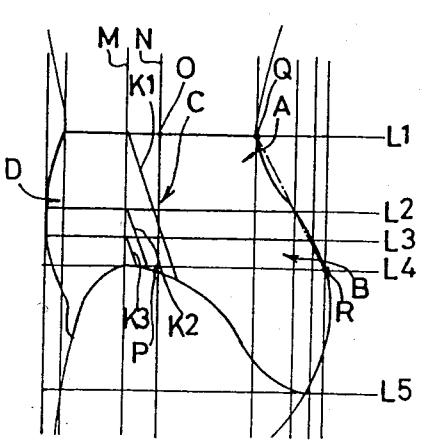
FIGS. 1 to 3 are diagrams showing curves of the lower abdomen and the buttocks of the human body and also showing three kinds of undergarments covering these body portions, FIG. 1 being a front view, FIG. 2 being a side elevation and FIG. 3 being a cross sectional view.
Figure 3:
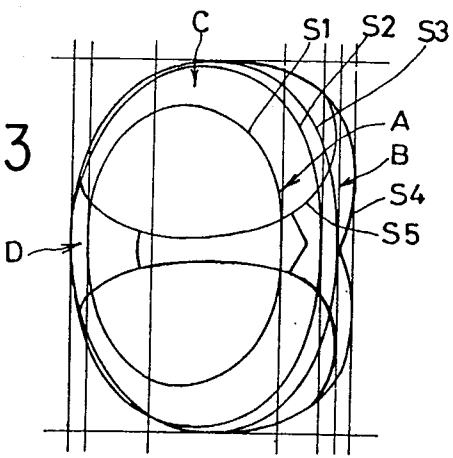
Figure 1:
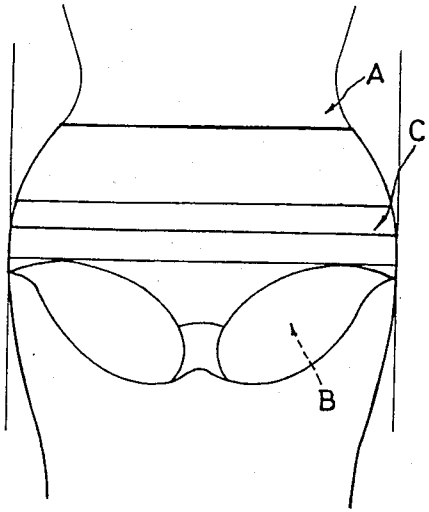

FIGS. 1 to 3 show curves defining the lower abdomen, waist and buttocks of the human body, and three kinds of undergarments. As is well known, the human body is constricted at the waist A. On the back side of the body below the waist A there are buttocks B bulging rearward from the waist A downward and separated from each other by the gluteal cleft. On each side of the human body, the lateral region C corresponding to the lateral part of the pelvis above the thigh is bulged outward. On the front side of the body, the lower abdomen D is slightly bulged forward.

FIG. 2 shows the following phantom lines: A center line N dividing the waist A into front and rear equal portions; a vertical line M dividing the waist A into front and rear portions in the ratio of about 1:2; a horizontal line L1 extending through the waist A; a horizontal line L2 extending through the most projecting portion of the lower abdomen D; a horizontal line L3 at a level slightly below the horizontal line L2; a horizontal line L4 at a level slightly above the most projecting portion of the buttock B; and a horizontal line L5 approximately at the level of the crotch. FIG. 3 shows cross sections S1 to S5 of the human body taken along the horizontal lines L1 to L5, respectively.

Figure 4:
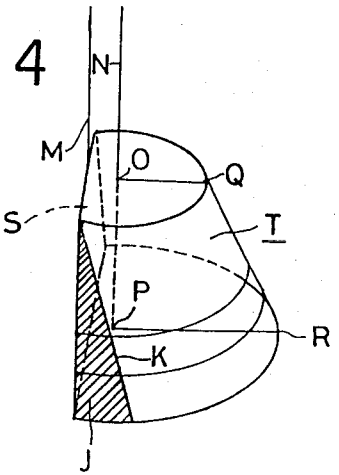
FIG. 4 is a perspective view showing a truncated cone segment serving as a model.

With reference to FIG. 2, the intersections of the center line N with the horizontal lines L1 and L4 are indicated at O and P, and the intersections of the curve defining the back of the human body with the horizontal lines L1 and L4 are designated at Q and R. The line through the points O, P, the line through the points Q, R and the horizontal lines L1, L4 form a trapezoid with legs of unequal lengths, the leg OP being vertical. The trapezoid, when rotated about the center line N, generates a truncated cone. When the truncated cone is divided by the plane containing the vertical line M and perpendicular to the drawing, two segments are obtained. FIG. 4 shows the segment T of the larger volume.

The truncated cone segment T will be considered to be a model of the portion of the human body from the waist to the buttocks, namely between the horizontal lines L1 and L4, rearward from the vertical line M. To be sure, the truncated cone segment T serving as the model slightly differs from the corresponding portion of the human body, because the cross sections of the body along the horizontal lines L1 to L3 resemble an ellipse, whereas the segment T is circular in horizontal cross section and further because the portion of the body from the waist to the buttocks has a complicatedly curved surface, whereas the segment T has a simply curved peripheral surface. However, the segment T is a very useful model in considering the bulges of the buttocks B and lateral regions C of the body.

Figure 5:
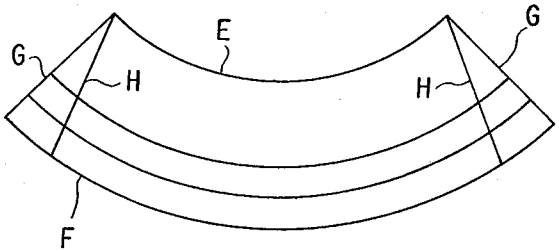
FIG. 5 is a development showing the peripheral surface of the truncated cone segment.

FIG. 5 is a development showing the peripheral surface of the truncated cone segment T other than its cut surface S. With reference to this development, the segment has an upper edge E and a lower edge F both of which are in the form of a circular arc and are curved upward toward their opposite ends. The sides G at the opposite ends are inclined upward toward the center line of the development. A piece of fabric cut out in conformity with the development will adequately and fully cover the peripheral surface of the segment T except its cut surface S. It is assumed that the segment T has a phantom line K on its peripheral surface as seen in FIG. 4. The line K extends on the peripheral surface approximately in parallel to the line QR from a corner of the cut surface S at the upper edge of the segment T. When portions J each defined by the line K and the vertical edge of the cut surface S are removed from the cut-out piece covering the peripheral surface of the segment T, the resulting piece has a shape defined by the circular arcs E, F and lines H. The sides H at the opposite ends of the cut piece are also inclined upward toward the center line of the cut piece.

This invention provides three kinds of undergarments, the first of which is of the deep type. When worn, the garment of this type has its upper hem positioned at the horizontal line L1 and completely covers the buttocks B and also the bulging lower abdomen D. When the second undergarment, which is the medium depth type, is worn, the upper hem thereof is positioned at the horizontal line L2. The third is of the shallow type, which when worn, has its upper hem positioned at the horizontal line L3. As will be described later, the undergarments of the medium and shallow types also fully cover the buttocks. Any of these three types of undergarments is designed to have a straight horizontal upper hem when worn.

As will become apparent from the description to follow, the undergarments of this invention comprise a front piece for covering the lower abdomen, a rear piece for covering the buttocks and a connector piece interconnecting the front piece and the rear piece for covering the crotch. The front piece and the rear piece are stitched to each other at their opposite upper side portions. Indicated at K1, K2 and K3 in FIG. 2 are the seams of the undergarments of the deep type, medium type and shallow type, respectively, between the opposed upper side portions of the front piece and the rear piece. The seams K1, K2 and K3 have their upper ends on the vertical line M and extend rearwardly obliquely downward. The seam K1 corresponds to the line K drawn on the model segment T. Since the seams K1, K2 and K3 are located predominantly forward from the center line N and extend approximately in parallel to the line QR, the seams appear graceful.

Figure 6:
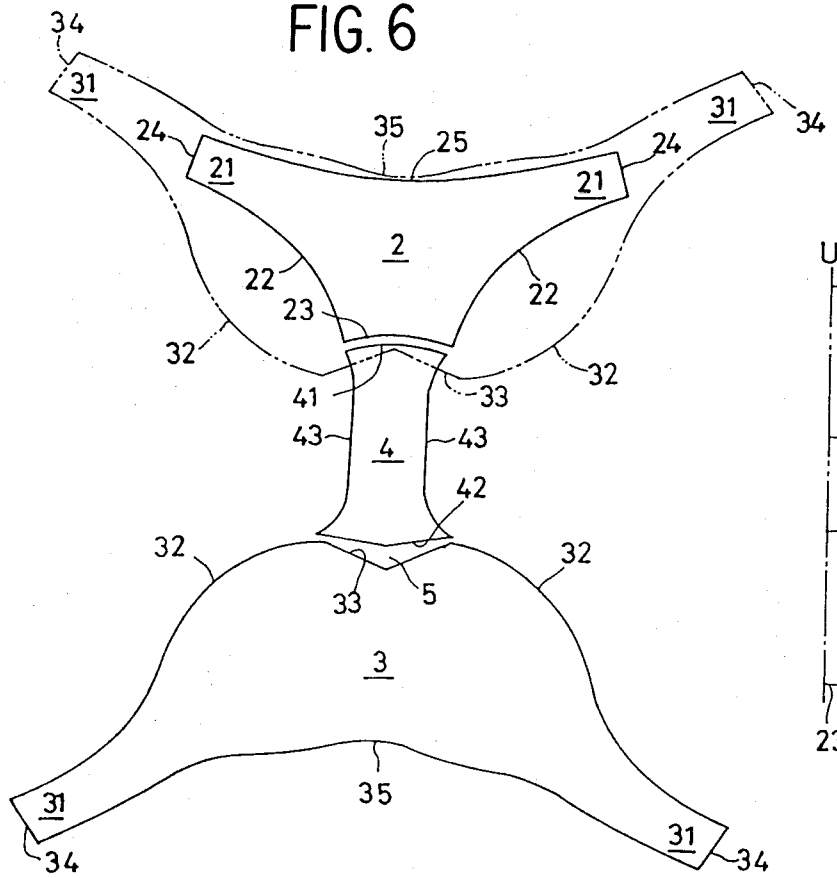
FIG. 6 is a plan view showing a front piece, a rear piece and a connector piece which are cut out for making an undergarment of the shallow type.
Figure 10:
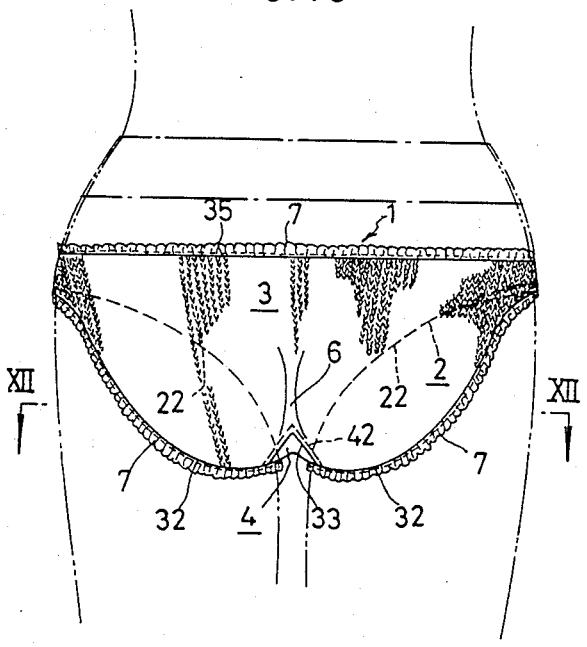
FIGS. 10 to 12 are views showing an undergarment worn on the human body, FIG. 10 being a rear view, FIG. 11 being a side elevation and FIG. 12 being a view in cross section taken along the line XII—XII in FIG. 10.
Figure 11:
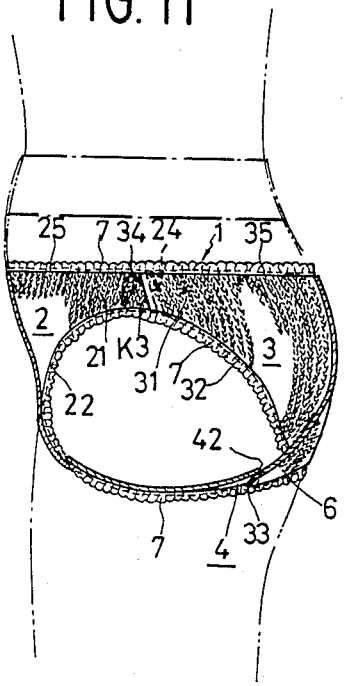
Figure 12:
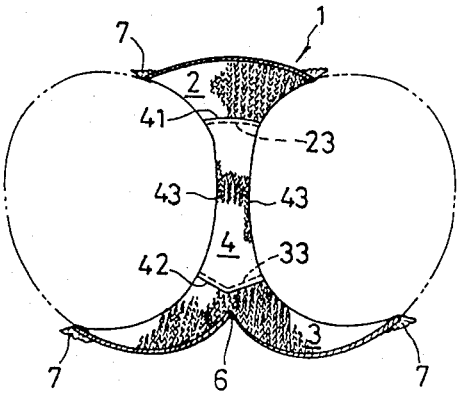

FIG. 6 shows cut component pieces for making an undergarment of the shallow type. FIGS. 10 to 12 show the undergarment of the shallow type worn on the human body. The undergarment 1, such as panties, briefs or the like, comprises a front piece 2 for covering the lower abdomen, a rear piece 3 chiefly for covering the buttocks, and a connector piece 4 interconnecting the front piece 2 and the rear piece 3 for covering the crotch. These pieces 2 to 4 are most preferably made of a stretchable knitted fabric. However, other knitted fabrics, woven fabrics or nonwoven fabrics are similarly usable.

The front piece 2 has projections 21 at its upper opposite side portions. The projections 21 extend slightly obliquely upward and terminate at ends 24 which are inclined upward toward the center line of the front piece 2. The front piece 2 has a gently curved upper edge 25 which is recessed to the greatest extent at the midportion. The front piece 2 has a width progressively decreasing downward. The side edges 22 of the front piece 2 are curved inward in conformity with the groin between the thigh and the abdomen or with a part slightly above the groin. The lower end 23 of the front piece 2 and one end 41 of the connector piece 4 are curved in conformity with each other and stitched together.

The rear piece 3 also has projections 31 extending outward from its upper opposite side portions obliquely upward. The projections 31 have ends 34 slanting upward toward the center line of the rear piece 3. The rear piece 3 has an upper edge 35 which is so curved that it is recessed to the greatest extent at its midportion when seen in its entirety. When seen in detail, the upper edge 35 is defined by a very slightly and gently projecting curve at each side of its midportion and extends obliquely upward where it corresponds to the upper edge of the projection 31. The rear piece 3 has edges 32 extending from its lower to side portions and curved in conformity with the curves of the buttocks. The area and shape of the portion of the rear piece 3 surrounded by the edges 32 are determined in accordance with the bulging degree and contours of the buttocks.

Figure 7:
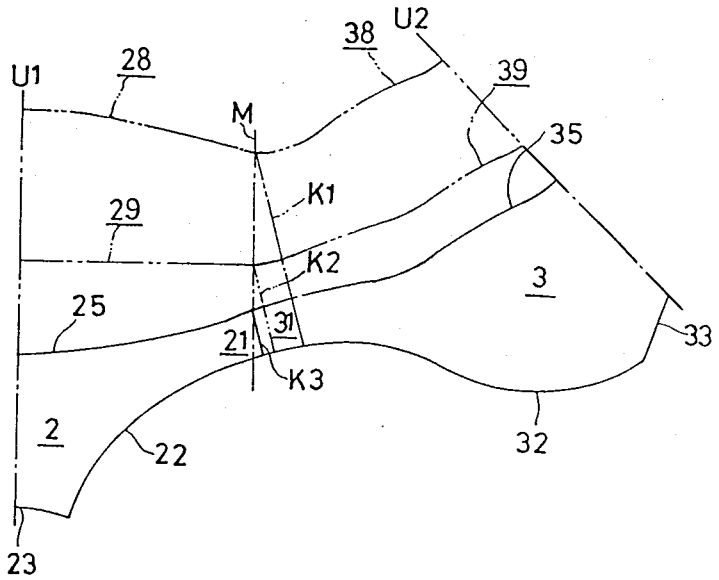
FIG. 7 is a fragmentary plan view showing the front piece and the rear piece which are stitched together.

The ends 24 of the projections 21 of the front piece 2 are stitched to the ends 34 of the projections 31 of the rear piece 3 as seen in FIG. 7, whereby portions for covering the lateral regions C are formed. As already described, the bulges of the buttocks B and lateral regions C of the human body can be discussed with reference to the truncated cone segment T serving as a model. The upper edge E of the cut piece completely covering the peripheral surface of the segment T is defined by a circular arc curve which is most greatly recessed at its midportion. Similarly the upper edge 35 of the rear piece 3 is also circular arc when seen in its entirety. Accordingly it will be readily understood that when an undergarment including the rear piece 3 is worn, the rear piece 3 completely covers the buttocks B and the lateral regions C and that the upper hem of the undergarment, i.e. the upper edge 35 of the rear piece 3, is positioned along a straight line horizontally. Although the truncated cone segment T shown in FIG. 4 corresponds to an undergarment of the deep type, the concept is exactly true of undergarments of any depth, so that the model segment T, when having a reduced height, is similarly useful for undergarments of the shallow type. With reference to FIG. 7, the center line U1 of the front piece 2 is vertical, while the center line U2 of the rear piece 3 is inclined. When the undergarment made is worn, the center line U2 also is in a vertical position. It will be readily understood from FIG. 7 that when the center line U2 is vertical, the rear piece 3 bulges outward. The slight and gentle curves of the upper edge 35 of the rear piece 3, which are in conformity with slight and gentle undulations of the human body, may be designed in accordance with the form of the human body. Based on the same concept, the upper edge 25 of the front piece 2 is also gently curved, with the projections 21 inclined obliquely upward, because the projections 21 are also adapted to cover the bulging lateral regions C.

With reference to FIGS. 4 and 5, the cut piece for covering the peripheral surface of the segment T other than the portions J has ends H slanting upward toward the center line. The end H appears as the seam K1 in FIG. 2 (the same is true of the seams K2 and K3). By suitably determining the angle of inclination of the ends 24, 34 of the projections 21, 31 of the front and rear pieces 2, 3, such seams can be made to incline forwardly upward approximately in parallel to the line QR, as indicated at K3. Since the length of the rear piece 3 between the ends 34 is much larger than the length of the front piece 2 between the ends 24, the seam K3 appears at a location on the side closer to the lower abdomen as shown in FIG. 2.

The other end 42 of the connector piece 4 is defined by two edges slanting outward toward the center line thereof. The central lower end 33 of the rear piece 3 to be stitched to the end 42 is defined by two edges slanting upward toward its center line. These ends 33 and 42 differ in the angle of inclination, such that the ends 33 and 42 define a space 5 therebetween when placed in butting relation to each other before the rear piece 3 and the connector piece 4 are stitched together, as seen in FIG. 6. The space 5 has a progressively increasing width toward the center line thereof.

The rear piece 3 and the connector piece 4 are stitched together at the opposed ends 33 and 42 while the lower end portion 33 is being stretched toward the connector piece 4 to the greatest extent along the center line of the rear piece 3 and to a progressively lesser extent from the center line toward the opposite sides thereof. Since the rear piece 3 is thus stretched to the greatest extent on its center line, the garment 1 formed has an elongated depression 6 extending vertically on the center line of the rear piece 3 and conforming to the gluteal cleft between the buttocks. On the opposite sides of the depression 6, the rear piece 3 has rounded portions in conformity with the bulges of the buttocks since the rear piece 3 has the foregoing shape and the depression 6. Consequently the rear piece 3 of the undergarment 1 covers and supports the buttocks in intimate contact therewith, feels smooth and comfortable, and fits snugly to the curves of the buttocks and gluteal cleft, giving a graceful appearance.

Figure 9:
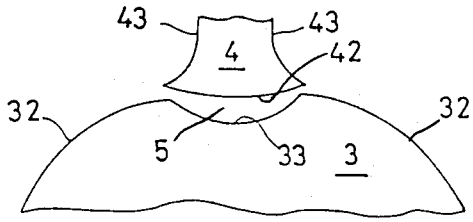
FIG. 9 is a fragmentary view of another embodiment, the view showing a rear piece and a connector piece which are cut out.

The lower end 33 of the rear piece 3 and the end 42 of the connector piece 4 to be stitched thereto may be arcuate as shown in FIG. 9. In this case, the space 5 formed between the ends 33 and 42 also has an increasing width toward its center and resembles a crescent in shape. Alternatively the depression 6 can be formed in an integral seamless piece of fabric including the rear piece 3 and the connector piece 4, by drawing the integral piece into a fold at the portion thereof corresponding to the junction of the above-mentioned ends 33 and 42 so that the rear piece portion of the integral piece will be stretched to the greatest extent on its center line, and fixing the folded portion suitably by stitching. In this case, the front piece 2 may be integral with or separate from the connector piece 4.

When desired, a stretchable and decorative tape 7 may be stitched to the upper edges 25, 35 of the front and rear pieces 2, 3 to be fitted around the waist and also to the side edges 22, 32, 43 of the front and rear pieces 2, 3 and the connector piece 4 to be fitted around the legs. The tape 7 is made partially or entirely from stretchable yarns, such as rubber yarns or spandex yarns, by knitting or weaving. When the tape 7 attached to the above-mentioned edges has suitable elasticity, the upper hem of the undergarment provided by the upper edges 25, 35 becomes straight while the undergarment has bulging portions for covering the buttocks and the lateral regions.

Figure 8:
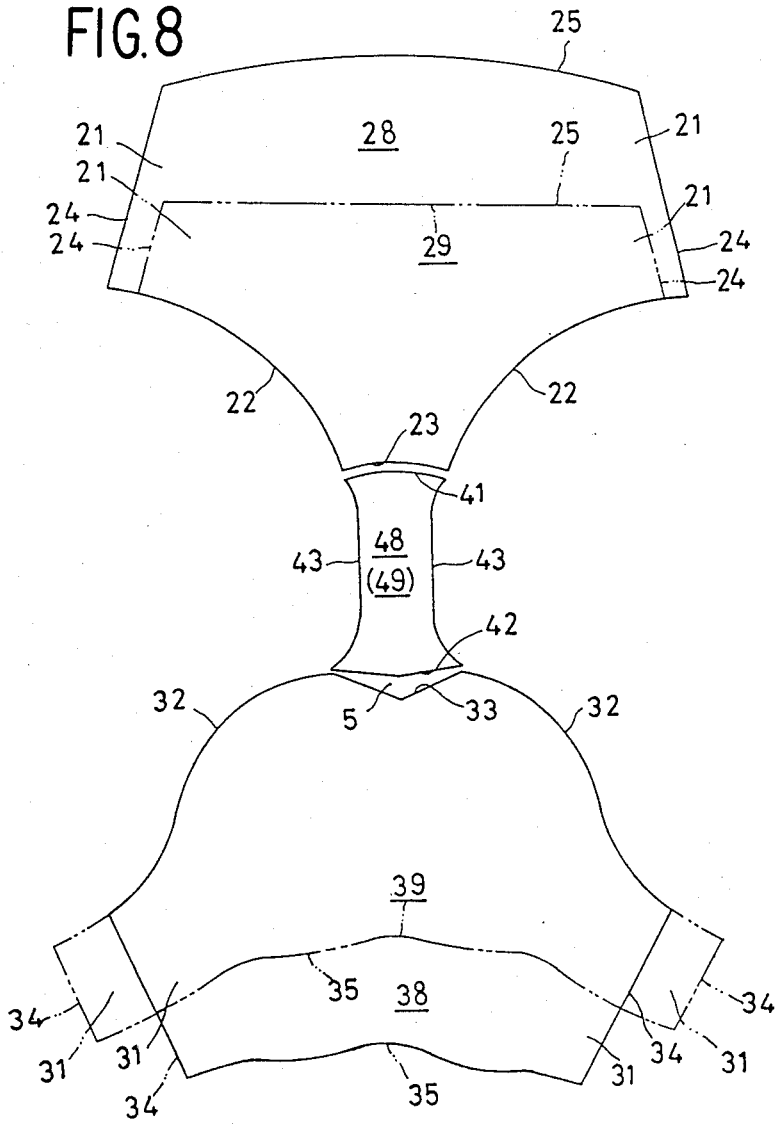
FIG. 8 is a plan view showing front pieces, rear pieces and connector pieces which are cut out for making undergarments of the medium depth type and the deep type.

FIG. 8 shows the component pieces of undergarments of the deep type and the medium depth type. The front piece, rear piece and connector piece constituting the undergarment of the deep type are indicated in solid lines and designated at 28, 38 and 48 respectively. Indicated in broken lines are the component pieces of the undergarments of the medium depth type, namely, front piece 29, rear piece 39 and connector piece 49. The projections, ends and edges of these component pieces, and the space are referred to by the same reference numerals as the corresponding parts of the undergarment of the shallow type shown in FIG. 6.

The rear pieces 38, 39 of the garments of the deep type and the medium type also have projections 31 extending outward from their upper opposite side portions obliquely upward and terminating at ends 34 which are inclined upward toward the center line of the rear piece. Each of the rear pieces 38, 39 has an upper edge 35 which is curved inward to the greatest extent at its midportion when seen in its entirety. The projections 31 of the medium type are wider than those of the shallow type. The projections 31 of the deep type are largest so that the upper edge 35 will reach the waist. The deep type, the medium type and the shallow type are larger relative to one another in the order mentioned in the length of the rear piece between the ends 34 thereof.

The front pieces 28, 29 also have projections 21 extending outward from their upper opposite side portions but are not inclined upward. The projections 21 have ends 24 inclined upward toward the center line of the front piece. The front piece 29 of the medium type is larger than that of the shallow type in the width of the projections 21 and has a horizontal straight upper edge 25. The portion of the front piece of the deep type including the projections 21 extends largely upward, and the projections 21 have a very large width. Unlike the shallow type, the front piece 29 of the deep type has an upper edge 25 curved to project upward to the greatest extent at its midportion. The shallow type, the medium type and the deep type are larger relative to one another in the order mentioned in the length of the front piece between the ends 24 of the projections 21. The other parts of the front pieces 28, 29, the rear pieces 38, 39 and the connector pieces 48, 49 are almost similar in shape to the corresponding parts of the undergarment of the shallow type. The front pieces 28, 29 and the rear pieces 38, 39 are stitched together to the opposed ends 24 and 34. The lower ends 23 of the front pieces 28, 29 are stitched to the ends 33 of the connector pieces 48, 49. The lower ends 33 of the rear pieces 38, 39 are stitched to the other ends 42 of the connector pieces 48, 49. Thus in the same manner as the undergarment of the shallow type, undergarments of the deep type and the medium type are prepared.

When the undergarments of the deep and medium types are worn, the upper hems 35 will be positioned horizontally along a straight line since the edges 35 of the rear pieces 38, 39 are curved inward to the greatest extent at their midportions. The front piece 28 of the undergarment of the deep type is large enough to fully cover the entire lower abdomen D bulging forward. With the front piece 28 bulged forward along the lower abdomen D, the upper edge 25 becomes horizontally along a straight line which edge is curved outward to the greatest extent at its midportion. The upper edge 25 is then positioned at the same level as the upper edge 35 of the rear piece 38. The front piece 29 of the undergarment of the medium depth type covers the lower half of the lower abdomen D, with its upper edge positioned intermediately between the position of the upper edge of the deep-type garment and that of the upper edge of the shallow-type garment. Since the front piece 29 bulges in conformity with the bulges of the lateral regions C and the bulge of the lower abdomen D, the straight upper edge 25 slightly lowers in its entirety to assume a straight position. The upper edge 25 is positioned at the same level as the upper edge 35 of the rear piece 39.

With the undergarments of the deep and medium types, the seams K1, K2 between the opposed ends 24, 34 of the front pieces 28, 29 and the rear pieces 38, 29 appear as lines slanting forwardly upward when seen from the side, as is the case with the garment of the shallow type. These seams K1, K2 are positioned some distances rearwardly away from the seam K3 in corresponding relation to the shortened lengths of the rear pieces 38, 39 between the ends 34.

Figures 13A, 13B, 13C:
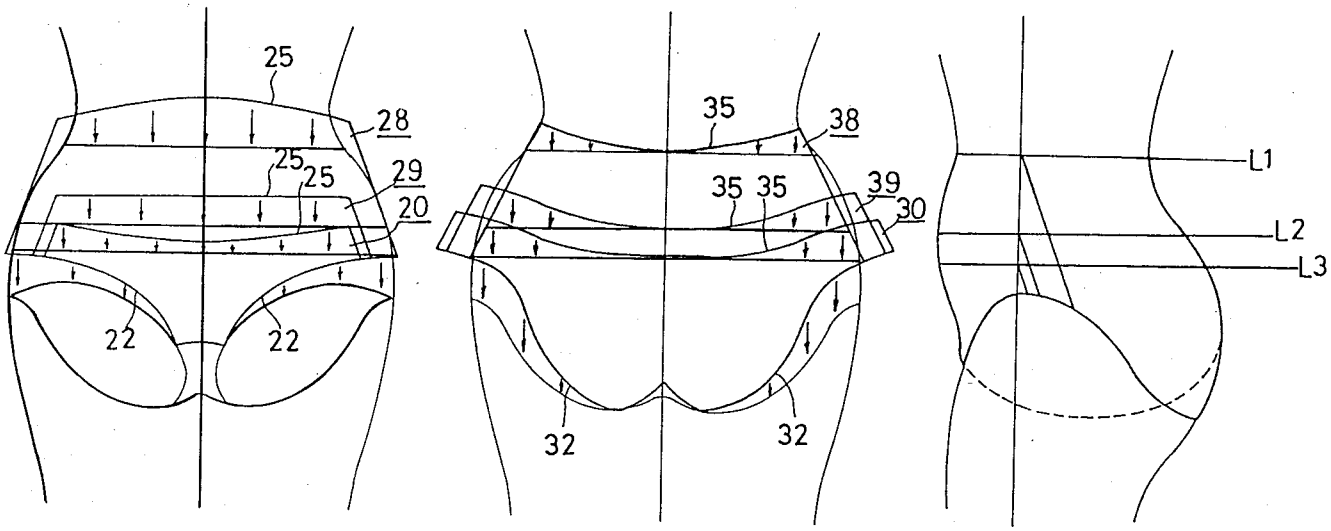
FIG. 13 includes diagrams collectively showing the component pieces for making undergarments of the shallow type, the medium depth type and the deep type.

FIG. 13 collectively shows the components of the undergarments of the shallow type, the medium type and the deep type. When the garments comprising these components as stitched together are worn, the upper edges 25 of the front pieces 20, 29, 28 and the upper edges 35 of the rear pieces 30, 39, 38 are lowered to the positions of the horizontal lines L3, L2, L1, respectively, as indicated by arrows owing to the bulges of the buttocks, lateral regions and lower abdomen. The side edges 22 of the front pieces 20, 29, 28 and the side edges 32 of the rear pieces 30, 39, 38 are also lowered as indicated by arrows. The gentle undulations of the upper edges 35 of the rear pieces 30, 39 and 38 are not shown in FIG. 13.

INDUSTRIAL APPLICABILITY

The underwear is one of the daily necessaries. Most of the undergarments are made by underwear makers. The underwear and the method of making same of this invention can be put into practice by the industry of underwear making and contribute to the developments of this industry.

I claim:

1. An undergarment comprising a front piece for covering the lower abdomen, a rear piece chiefly for covering the buttocks, and a connector piece interconnecting the front piece and the rear piece for covering the crotch, the front piece having a projection extending outwardly from each of its upper opposite side portions, the rear piece having a projection extending outwardly and obliquely upwardly from each of its upper opposite side portions, the rear piece having an upper edge curved inwardly toward a lower end thereof to the greatest extent on the center line of the rear piece, the projections of the front piece being stitched to the projections of the rear piece at their opposed ends, whereby the upper edge of the rear piece takes a position along a straight line horizontally when the undergarment is worn, the ends of the projections of each of the front piece and the rear piece are inclined upwardly toward the center line of the piece, and the length of each of the front piece and the rear piece between the ends of the projections thereof and the angle of inclination of the ends are so determined that when the undergarment is worn, the seams of the opposed ends incline upwardly forward as seen from the side.

2. An undergarment as defined in claim 1 wherein the ends of the projections of each of the front piece and the rear piece are inclined upwardly toward the center line of the piece.

3. An undergarment as defined in claim 1 wherein the front piece has an upper edge curved inwardly toward a lower end thereof to the greatest extent on the center line of the front piece, and the projections of the front piece extend obliquely upwardly.

4. An undergarment as defined in claim 1 wherein the front piece has a straight upper edge.

5. An undergarment as defined in claim 1 wherein the front piece has an upper edge curved to project outwardly away from a lower end thereof to the greatest extent on the center line of the front piece.

6. An undergarment as defined in claim 5 wherein the seams are positioned forward from the center line of the wearer when seen from the side.

7. A method of making an undergarment by stitching together at suitable portions a front piece for covering the lower abdomen, a rear piece chiefly for covering the buttocks and a connector piece for covering the crotch, the method comprising forming on the front piece a projection extending outwardly from each of its upper opposite side portions, forming on the rear piece a projection extending outwardly and obliquely upwardly from each of its upper opposite side portions, forming on the rear piece an upper edge curved inward to the greatest extent on the center line of the rear piece, stitching the projections of the front piece to the projections of the rear piece at their opposed ends, and stitching the rear piece and the connector piece together at adjoining portions thereof while stretching the rear piece toward the connector piece to the greatest extent along the center line of the rear piece and to a progressively lesser extent from the center line toward the opposite sides thereof to form an elongated depression on the center line of the rear piece and a bulged portion on each side of the depression.

8. A shallow depth or low-rise type undergarment such as a panty, brief of the like, comprising a front piece for covering the lower abdomen, a rear piece chiefly for covering the buttocks, and a connector piece interconnecting the front piece and the rear piece for covering the crotch, the front piece being formed with opposite side edges curved inwardly toward a midportion therreof so as to cause the front piece to have a width progressively decreasing toward a lower end thereof, the front piece further being formed with projecting portions extending outwardly and obliquely upwardly from upper opposite side portions thereof, the rear piece being formed with opposite side edges extending curvedly outwardly from a lower end thereof to upper opposite side portions thereof and being further formed with projecting portions extending outwardly and obliquely upwardly from the upper opposite side portions thereof, each of the projecting portions of the front piece being joined to the corresponding projecting portions of the rear piece at opposed ends thereof, the lower end of the front piece and the lower end of the rear piece being each joined respectively to corresponding opposite ends of the connector piece, the front and rear pieces both having upper edges curved inwardly toward their respective lower ends to the greatest extent at their respective midportions between their respective upper opposite portions, with the upper edge of the rear piece defining a gently projecting curve at each side of the midportion thereof extending obliquely upwardly to upper edges of the projecting portions thereof, such that when the undergarment is worn upon the body an upper hem defined by the upper edges of the front and rear pieces is positioned along a straight horizontal line.

9. A medium depth or mid-rise type undergarment such as a panty, brief or the like, comprising a front piece for covering the lower abdomen, a rear piece chiefly for covering the buttocks, and a connector piece interconnecting the front piece and the rear piece for covering the crotch, the front piece being formed with opposite side edges curved inwardly toward a midportion thereof so as to cause the front piece to have a width progressively decreasing toward a lower end thereof, the front piece further being formed with projecting portions extending outwardly and obliquely upwardly from upper opposite side portions thereof, the rear piece having formed with opposite side edges extending curvedly outwardly from a lower end thereof to upper opposite side portions thereof and being further formed with projecting portions extending outwardly and obliquely upwardly from the upper opposite side portions thereof, each of the projecting portions of the front piece being jointed to the corresponding projecting portions of the rear piece at opposed ends thereof, the lower end of the front piece and the lower end of the rear piece being each joined respectively to corresponding opposite ends of the connector piece, the front piece having a straight upper edge extending between upper edges of the projecting portions thereof, and the rear piece having an upper edge curved inwardly toward the lower end thereof to the greatest extend at the midportion thereof between the projecting portions thereof, such that when the undergarment is worn upon the body an upper hem defined by the upper edges of the front and rear pieces is positioned along a straight horizontal line.

10. A full depth or high-rise type undergarment such as a panty, brief or the like, comprising a front piece for completely covering the bulge of the lower abdomen, a rear piece for completely covering the buttocks, and a connector piece interconnecting the front piece and the rear piece for covering the crotch, the front piece being formed with opposite side edges curved inwardly toward a midportion thereof so as to cause the front piece to have a width progressively decreasing toward a lower end thereof, the front piece further being formed with projecting portions extending outwardly from upper opposite side portions thereof, the rear piece being formed with opposite side edges extending curvedly outwardly from a lower end thereof to upper opposite side portions thereof and being further formed with projecting portions extending outwardly and obliquely upwardly from the upper opposite side portions thereof, each of the projecting portions of the front piece being joined to the corresponding projecting portions of the rear piece at opposed ends thereof, the lower end of the front piece and the lower end of the rear piece being each joined respectively to corresponding opposite ends of the connector piece, the front piece having an upper edge curvedly projecting outwardly away from the lower end thereof to the greatest extent at the midportion thereof between the ends of the projecting portions thereof, and the rear piece having an upper edge curved inwardly toward the lower end thereof to the greatest extent at the midportion thereof between the projecting portions thereof such that when the undergarment is worn upon the body an upper hem defined by the upper edges of the front and rear pieces is positioned along a straight horizontal line.

* * * * *